US008723764B2

(12) United States Patent
Kim

(10) Patent No.: US 8,723,764 B2
(45) Date of Patent: May 13, 2014

(54) PIXEL AND ORGANIC LIGHT EMITTING DISPLAY DEVICE USING THE SAME

(75) Inventor: Yang-Wan Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 688 days.

(21) Appl. No.: 13/005,272

(22) Filed: Jan. 12, 2011

(65) Prior Publication Data

US 2012/0026146 A1 Feb. 2, 2012

(30) Foreign Application Priority Data

Aug. 2, 2010 (KR) ..... 10-2010-0074650

(51) Int. Cl.
*G09G 3/32* (2006.01)

(52) U.S. Cl.
USPC ..... 345/82; 345/76; 345/89; 345/92; 315/169.1; 315/169.3

(58) Field of Classification Search
USPC ..... 345/76–100, 204, 690, 9; 315/169.1–169.3
See application file for complete search history.

(56) References Cited

U.S. PATENT DOCUMENTS

2006/0066532 A1* 3/2006 Jeong ..... 345/76
2008/0111804 A1* 5/2008 Choi et al. ..... 345/205
2010/0141564 A1 6/2010 Choi et al.
2011/0018855 A1* 1/2011 Miyazawa ..... 345/211

FOREIGN PATENT DOCUMENTS

KR 10-0907391 B1 7/2009
KR 10-2010-0064620 6/2010

* cited by examiner

*Primary Examiner* — Jennifer Nguyen
(74) *Attorney, Agent, or Firm* — Christie, Parker & Hale, LLP

(57) ABSTRACT

A pixel to compensate for the deterioration of an organic light emitting diode, the pixel including an organic light emitting diode; a pixel circuit including a driving transistor controlling an amount of current supplied to the organic light emitting diode; and a compensator compensating for the deterioration of the organic light emitting diode by using on-voltage applied when current flows in the organic light emitting diode and off-voltage applied when current does not flow in the organic light emitting diode; wherein the compensator includes: a compensating capacitor having a second terminal connected to a gate electrode of the driving transistor; and a first compensating transistor connected between a first terminal of the compensating capacitor and an anode electrode of the organic light emitting diode.

27 Claims, 6 Drawing Sheets

PIXEL AND ORGANIC LIGHT EMITTING DISPLAY DEVICE USING THE SAME

CROSS-REFERENCE TO RELATED APPLICATION

This application claims the benefit of Korean Application No. 10-2010-0074650, filed Aug. 2, 2010, in the Korean Intellectual Property Office, the disclosure of which is incorporated herein by reference.

BACKGROUND OF THE INVENTION

1. Field of the Invention

An aspect of the present invention relates to a pixel and an organic light emitting display device using the pixel, and more particularly to a pixel that compensates deterioration of an organic light emitting diode and an organic light emitting display device using the pixel.

2. Description of the Related Art

Recently, a variety of flat panel displays having reduced weight and volume as compared to cathode ray tubes, have been developed. Typical flat panel displays include a liquid crystal display, a field emission display, a plasma display panel, and an organic light emitting display device, etc.

The organic light emitting display device displays an image, using an organic light emitting diode that produces light by recombining an electrode and a hole. The organic light emitting display device has the advantage that it has high response speed and is driven by low power.

FIG. 1 is a circuit diagram illustrating a pixel of an organic light emitting display device in the related art. Referring to FIG. 1, a pixel 4 of an organic light emitting display device of the related art includes: an organic light emitting diode OLED; and a pixel circuit 2 connected with a data line Dm and a scan line Sn and controlling the organic light emitting diode OLED.

The anode electrode of the organic light emitting diode OLED is connected to the pixel circuit 2 and the cathode electrode is connected to the second power supply ELVSS. The organic light emitting diode produces light with predetermined luminance in response to the current supplied from the pixel circuit 2.

The pixel circuit 2 controls the amount of current supplied to the organic light emitting diode OLED, in response to a data signal supplied to the data line Dm, when a scan signal is supplied to the scan line Sn. For this configuration, the pixel circuit 2 includes: a second transistor connected between a first power supply ELVDD and the organic light emitting diode OLED; a first transistor M1 connected between the second transistor M2, the data line Dm, and the scan line Sn; and a storage capacitor Cst connected between a gate electrode and a first electrode of the second transistor M2.

A gate electrode of the first transistor M1 is connected to the scan line Sn and a first electrode is connected to the data line Dm. Further, a second electrode of the first transistor M1 is connected to one terminal of the storage capacitor Cst. In this configuration, the first electrode is any one of a source electrode and a drain electrode and the second electrode is the other electrode different from the first electrode. For example, when the first electrode is the source electrode, the second electrode is the drain electrode. The first transistor M1 connected to the scan line Sn and the data line Dm is turned on and supplies a data signal, which is supplied through the data line Dm, to the storage capacitor Cst. In this operation, the storage capacitor Cst is charged to a voltage corresponding to the data signal.

The gate electrode of the second transistor M2 is connected to one terminal of the storage capacitor Cst and the first electrode of the second transistor M2 is connected to the first power supply ELVDD and the other terminal of the storage capacitor Cst. Further, the second electrode of the second transistor M2 is connected to the anode of the organic light emitting diode OLED. The second transistor M2 controls the amount of current flowing from the first power supply ELVDD to the second power supply ELVSS through the organic light emitting diode OLED, in response to the voltage value stored in the storage capacitor Cst. In this configuration, the organic light emitting diode OLED emits light corresponding to the amount of current supplied from the second transistor M2.

However, the organic light emitting display device having the above configuration according to the related art has a problem that it cannot display an image with desired luminance, by efficiency change due to the deterioration of the organic light emitting diode. In other words, as time passes, the organic light emitting diode is deteriorated and accordingly it is not possible to display an image with a desired luminance.

SUMMARY OF THE INVENTION

An aspect of the present invention provides a pixel compensating deterioration of an organic light emitting diode, and an organic light emitting display device using the pixel.

Another aspect of the present invention provides a pixel that can compensate deterioration of an organic light emitting diode, regardless of voltage drop of a second power supply ELVSS, and an organic light emitting display device using the pixel.

According to an aspect of the present invention, there is provided a pixel including: an organic light emitting diode; a pixel circuit including a driving transistor controlling an amount of current supplied to the organic light emitting diode; and a compensator compensating deterioration of the organic light emitting diode by using on-voltage applied when current flows in the organic light emitting diode and off-voltage applied when current does not flow in the organic light emitting diode; the compensator including: a compensating capacitor having a second terminal connected to a gate electrode of the driving transistor; and a first compensating transistor connected between a first terminal of the compensating capacitor and an anode electrode of the organic light emitting diode.

According to another aspect of the present invention, the driving transistor controls current flowing to the organic light emitting diode in response to a data signal transmitted when a first scan signal is supplied to an i-th (i is a natural number) first scan line. The first compensating transistor is turned on for a first period and a second period after the first period of one frame period, in response to a second scan signal supplied to the i-th second scan line. The first period is a period when the first scan signal is supplied to the i-th first scan signal and the second period is a period when the first scan signal is supplied to an i+1-th first scan line. The on-voltage is supplied to the first terminal of the compensating capacitor for the first period and the off-voltage is supplied to the first terminal of the compensating capacitor for the second period. The compensator further includes a second compensating transistor that is connected between the first terminal of the compensating capacitor and the anode electrode of the organic light emitting diode and islurned on at a different time from the first compensating transistor. The first compensating transistor is turned on when the first scan signal is supplied to the 1-th first scan line and the second compensating transistor is turned on when the first scan signal is supplied to the i+1-th first scan line.

According to another aspect of the present invention, the on-voltage is supplied to the first terminal of the compensating capacitor when the first compensating transistor is turned on, and the off-voltage is supplied to the first terminal of the compensating capacitor when the second compensating transistor is turned on. The pixel circuit includes: a first capacitor connected between a gate electrode of the driving transistor and a first power supply; a second transistor connected between the gate electrode of the driving transistor and a data line and turned on when the first scan signal is supplied to the i-th first scan line; and a third transistor connected between a second electrode of the driving transistor and the organic light emitting diode and turned off when an emission control signal is supplied to an i-th emission control line. The emission control signal supplied to the i-th emission control line overlaps the first scan signal supplied to an i+1-th first scan line.

According to another aspect of the present invention, the pixel circuit further includes: a fourth transistor connected between the gate electrode and the second electrode of the driving transistor and is turned on when the first scan signal is supplied to the i−1-th scan line; a second transistor connected between the gate electrode of the driving transistor and the second electrode of the second transistor; a fifth transistor connected between the second electrode of the second transistor and a reference power supply and turned on when the first scan signal is supplied to the i−1-th first scan line; and a sixth transistor connected between the gate electrode of the driving transistor and an initial power supply and turned on when the first scan signal is supplied to the i−2-th first scan line. The reference power supply is set at voltage higher than the data signal. The initial power supply is set at a voltage lower than the data signal. The emission control signal supplied to the i-th emission control line overlaps the first scan signal supplied to an i−2-th first scan line, an i−1-th first scan line, and an i+1-th first scan line, except for the first scan line supplied to the i-th first scan line. The second terminal of the compensating capacitor is connected to the second electrode of the second transistor.

According to another aspect of the present invention, the more the organic light emitting diode is deteriorated, the larger the increase ratio of the on-voltage, as compared with the off-voltage.

According to another embodiment of the present invention, there is provided an organic light emitting display device, including: a scan driver sequentially supplying first scan signals to first scan lines; a data driver supplying data signals to data lines to be synchronized with the first scan signals; and pixels positioned at intersections of the first scan lines and the data lines, in which the pixels positioned in an i-th (i is a natural number) horizontal line each include: a pixel circuit including a driving transistor controlling the amount of current supplied to the organic light emitting diode; and a compensator compensating deterioration of the organic light emitting diode by using on-voltage applied when current flows in the organic light emitting diode and off-voltage applied when current does not flow in the organic light emitting diode, and the compensator includes: a compensating capacitor having a second terminal connected to a gate electrode of the driving transistor; and a first compensating transistor connected between a first terminal of the compensating capacitor and an anode electrode of the organic light emitting diode.

According to another aspect of the present invention, second scan lines are formed in parallel with the first scan lines, and the first compensating transistor is turned on when a second scan signal is supplied to an i-th second scan line. The scan driver supplies a first second scan signal to the i-th second scan line to overlap the first scan signal supplied to an i-th first scan line, and supplies a second second scan signal to the i-th second scan line to overlap the second scan signal supplied to an i+1-th scan line. The compensator further includes a second compensating transistor that is connected between the first terminal of the compensating capacitor and the anode electrode of the organic light emitting diode and is turned on at a different time from the first compensating transistor. The first compensating transistor is turned on when the first scan signal is supplied to the 1-th first scan line and the second compensating transistor is turned on when the first scan signal is supplied to the i+1-th first scan line.

According to another aspect of the present invention, it is possible to control voltage of a gate electrode of a driving transistor such that deterioration of an organic light emitting diode can be compensated, making it possible to display an image with desired luminance. Further, it is possible to compensate deterioration of the organic light emitting diode (OLED), regardless of voltage drop of a second power supply ELVSS, because on-voltage and off-voltage of the organic light emitting diode according to an aspect of the present invention are used.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
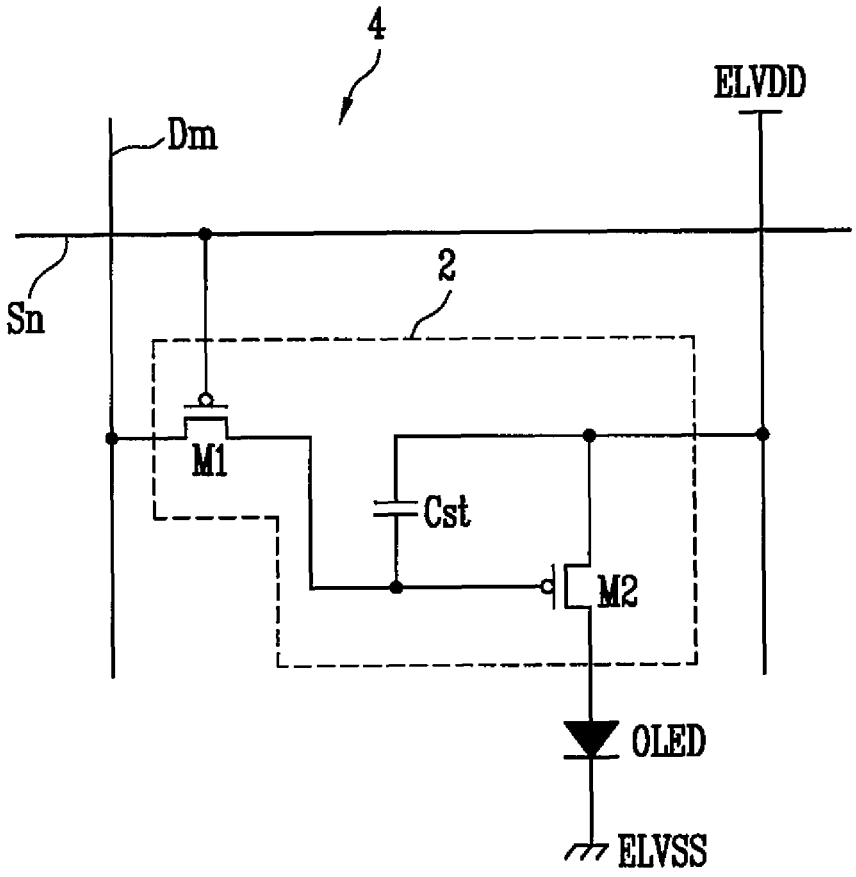
FIG. 1 (Related Art)
FIG. 1 is a circuit diagram illustrating a pixel of the related art.

Reference will now be made in detail to the present embodiments of the present invention, examples of which are illustrated in the accompanying drawings, wherein like reference numerals refer to the like elements throughout. The embodiments are described below in order to explain the aspects of the present invention by referring to the figures.

Figure 2:
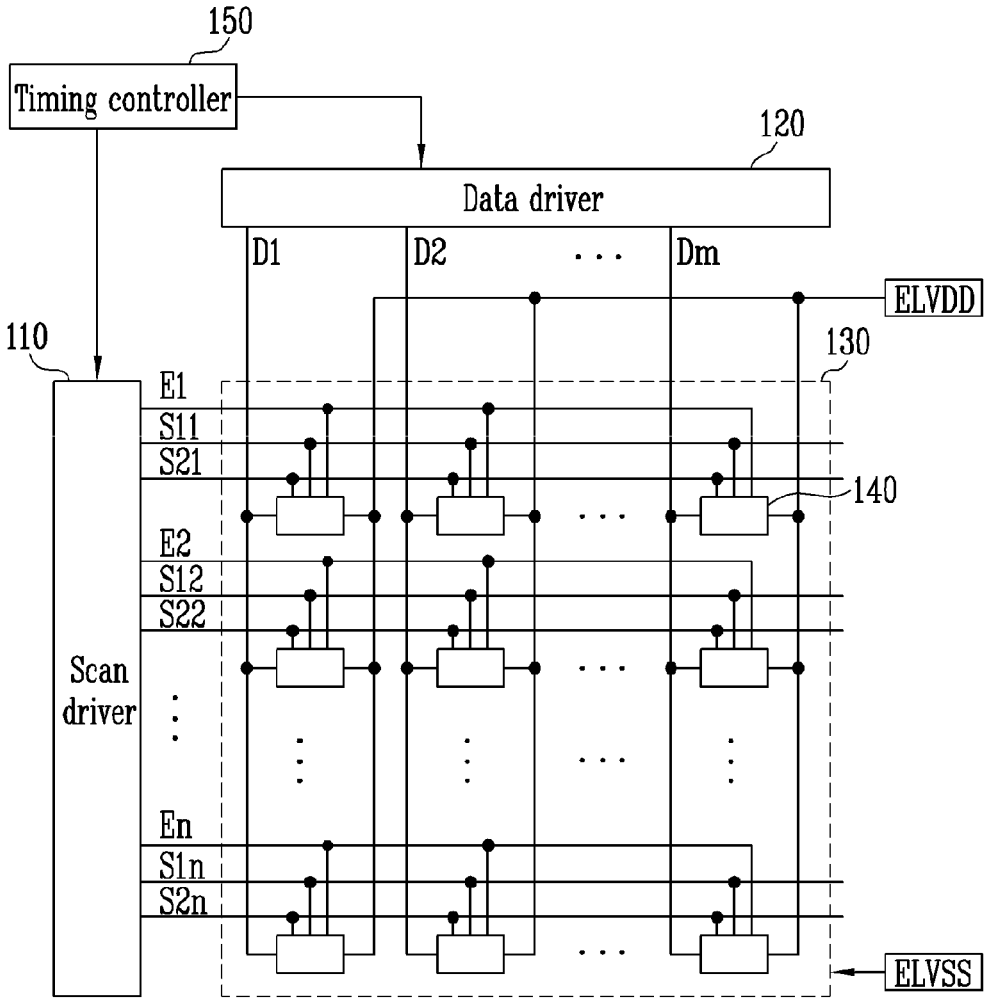
FIG. 2 is a diagram illustrating an organic light emitting display device according to an embodiment of the present invention.

FIG. 2 is a diagram illustrating an organic light emitting display device according to an embodiment of the present invention. Referring to FIG. 2, an organic light emitting display device includes a pixel unit 130 including pixels 140 positioned at the intersections of first scan lines S11 to S1*n*, second scan lines S21 to S2*n*, emission control lines E1 to En, and data lines D1 to Dm, a scan driver 110 driving the first scan lines S11 to S1*n*, the second scan lines S21 to S2*n*, and the emission control lines E1 to En, a data driver 120 driving the data lines D1 to Dm, and a timing controller 150 controlling the scan driver 110 and the data driver 120.

The scan driver 110 supplies first scan signals to the first scan signal lines S11 to S1*n* and second scan signals to the second scan lines S21 to S2*n*, by control of the timing controller 150. Further, the scan driver 110 supplies emission control signals to the emission control lines E1 to En, by the control of the timing controller 150.

The scan driver 110 sequentially supplies one first scan signal to each of the first scan lines S11 to S1*n*. Further, the scan driver 110 sequentially supplies two second scan signals to the second scan lines S21 to S2*n*. The first second scan signal supplied to the i-th (i is a natural number) second scan line S2*i* overlaps the first scan signal supplied to the i-th first scan line S1*i*, and the second second scan signal overlaps the first scan signal supplied to the i+1-th first scan line S1*i*+1. Further, the scan driver 110 supplies an emission control signal to the i-th emission control line Ei to overlap the second second scan signal supplied to the i-th second scan lien S2*i*.

Meanwhile, the emission control signal is set to a voltage (e.g. high polarity) in which the transistors in the pixels 140 can be turned off, and the first scan signal and the second scan signal are set to a voltage (e.g. low polarity) in which the transistors can be turned on.

The data driver 120 generates data signals by control of the timing controller 150 and supplies the generated data signals to the data lines D1 to Dm to be synchronized with the first scan signals.

The timing controller 150 controls the scan driver 110 and the data driver 120. Further, the timing controller 150 transmits data supplied from the outside to the data driver 120.

The pixel unit 130 supplies power, which is supplied from the first power supply ELVDD and the second power supply ELVSS at the outside, to the pixels 140. The pixels 140 supplied with the power from the first power supply ELVDD and the second power supply ELVSS produce light corresponding to a data signal.

The pixels generate light with desired luminance by compensating for the deterioration of the organic light emitting diodes therein. In detail, the emission efficiency decreases with the deterioration of the organic light emitting diode, such that the luminance of the generated light is reduced. Therefore, the pixels 140 compensate for the deterioration of the organic light emitting diode by increasing the amount of current supplied to the organic light emitting diode, in accordance with the deterioration of the organic light emitting diode.

Figure 3:
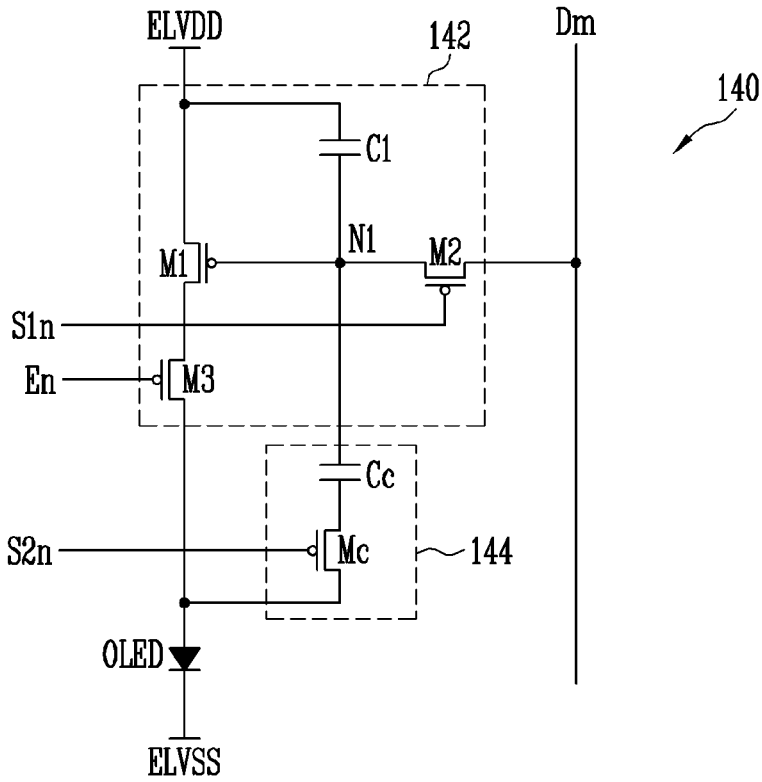
FIG. 3 is a diagram illustrating an embodiment of a pixel shown in FIG. 2.

FIG. 3 is a diagram illustrating the pixel shown in FIG. 2. The pixels connected with the 1*n*-th scan line S1*n* and the m-th data line Dm is shown in FIG. 3, for the convenience of description.

Referring to FIG. 3, a pixel 140 includes a organic light emitting diode OLED, a pixel circuit 142 controlling an amount of current supplied to the organic light emitting diode OLED, and a compensator 144 controlling control of a gate electrode of a driving transistor M1 included in the pixel circuit 142 in accordance with deterioration of the organic light emitting diode OLED.

The anode electrode of the organic light emitting diode OLED is connected to the pixel circuit 142 and the cathode electrode of the organic light emitting diode OLED is connected to the second power supply ELVSS. The organic light emitting diode OLED produces light with predetermined luminance in response to the current supplied from the pixel circuit 142. For this configuration, the first power supply ELVDD is set at a voltage higher than the second power supply ELVSS.

The pixel circuit 142 controls the amount of current supplied to the organic light emitting diode OLED in response to the data signal. For convenience, it is exemplified that three transistors M1 to M3 and one capacitor C1 are included in the pixel circuit 142 as shown in FIG. 3. However, aspects of the present invention are not limited thereto and more or less transistors and capacitors may be present. Practically, the pixel circuit 142 can be implemented by various circuits known in the art.

A gate electrode of the first transistor M1 is connected to a first node N1 and a first electrode of the first transistor M1 is connected to the first power supply ELVDD. Further, a second electrode of the first transistor M1 is connected to a first electrode of the third transistor M3. The first transistor M1 controls the amount of current flowing from the first power supply ELVDD to the second power supply ELVSS through the organic light emitting diode OLED, in response to the voltage applied to the first node N1.

A first electrode of the second transistor M2 is connected to the data line Dm and a second electrode of the second transistor M2 is connected to the first node N1. Further, a gate electrode of the second transistor M2 is connected to the first scan line S1*n*. The second transistor M2 is turned on and electrically connects the data line Dm with the first node N1, when the first scan signal is supplied to the first scan line S1*n*.

A first electrode of the third transistor M3 is connected to a second electrode of the first transistor M1 and a second electrode of the third transistor M3 is connected to the anode of the organic light emitting diode OLED. Further, the gate electrode of the third transistor M3 is connected to the emission control line En. The third transistor having this configuration is turned off when an emission signal is supplied to the emission control line En.

The first capacitor C1 is connected between the first node N1 and the first power supply ELVDD. The first capacitor C1 is charged to a voltage corresponding to the data signal.

The compensator 144 controls voltage of the first node N1 in accordance with deterioration of the organic light emitting diode OLED. For this operation, the compensator 144 includes a compensating transistor Mc and a compensating capacitor Cc.

The compensating transistor Mc has a first electrode connected to the anode electrode of the organic light emitting diode OLED and a second electrode connected to a first terminal of the compensating capacitor Cc. Further, a gate electrode of the compensating transistor Mc is connected to the second scan line S2*n*. The compensating transistor Mc is turned on and electrically connects the anode electrode of the organic light emitting diode OLED with the first terminal of the compensating capacitor Cc, when a second scan signal is supplied to the second scan line S2*n*.

The first terminal of the compensating capacitor Cc is connected to the second electrode of the compensating transistor Mc and the second electrode of the compensating capacitor Cc is connected to the first node N1. The compensating capacitor Cc controls voltage of the first node N1 in accordance with voltage changes of the organic light emitting diode OLED.

Figure 4:
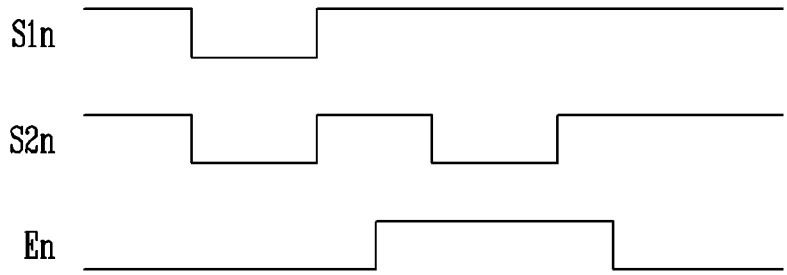
FIG. 4 is a waveform diagram illustrating a method of driving the pixel shown in FIG. 3.

FIG. 4 is a waveform diagram illustrating a method of driving the pixel shown in FIG. 3. Referring to FIG. 4, a scan signal is supplied to the first scan line S1*n*, and a first second scan signal is supplied to the second scan line S2*n*.

As the first scan signal is supplied to the first scan signal S1*n*, the second transistor M2 is turned on. As the second transistor M2 is turned on, a data signal is supplied from the data line Dm to the first node N1, and accordingly, the first capacitor C1 is charged at a voltage corresponding to the data signal. In this operation, the first transistor M1 supplies current corresponding to the voltage applied to the first node N1 to the organic light emitting diode OLED through the third transistor M3, and accordingly, a predetermined voltage is applied to the organic light emitting diode OLED. Hereafter, for the convenience of description, the voltage applied to the organic light emitting diode OLED, corresponding to the current supplied from the first transistor M1, is referred to as on-voltage of the organic light emitting diode OLED.

As the first second scan signal is supplied to the second scan line S2*n*, the compensating transistor Mc is turned on. As the compensating transistor Mc is turned on, the on-voltage of the organic light emitting diode OLED is supplied to the first terminal of the compensating capacitor Cc. That is, while the data signal is supplied to the first node N1, the first terminal of the compensating capacitor Cc is set to the on-voltage of the organic light emitting diode OLED.

Thereafter, the second second scan signal is supplied to the second scan line S2*n* and the emission control signal is supplied to the emission control line En to overlap the second scan signal. As the emission control signal is supplied to the emission control line En, the third transistor M3 is turned off As the third transistor M3 is turned off, the first transistor M1 and the anode electrode of the organic light emitting diode OLED are electrically disconnected. Hereafter, for the convenience of description, the voltage applied to the organic light emitting diode OLED when the organic light emitting diode OLED and the first transistor M1 are electrically disconnected is referred to as an off-voltage of the organic light emitting diode OLED.

As the second second scan signal is supplied to the second scan line S2*n*, the compensating transistor Mc is turned on. As the compensating transistor Mc is turned on, the off-voltage of the organic light emitting diode OLED is supplied to the first terminal of the compensating capacitor Cc. The compensating capacitor Cc controls voltage of the first node N1 in accordance with voltage changes of the organic light emitting diode OLED.

$$Vg(V_{N1})=V_{data}+Cc/(Cc+C1)\times(-(\mathrm{On}_{Voltage}-\mathrm{Off}_{Voltage})) \quad \text{[Formula 1]}$$

Vdata is voltage of the data signal in Formula 1. Further, —(on voltage—off voltage) is a voltage drop ratio of the first node N1 to a voltage difference between the on-voltage and the off-voltage.

In detail, the more the organic light emitting diode OLED is deteriorated, the more the resistance increases, and accordingly, the on-voltage of the organic light emitting diode OLED increases (practically, the off-voltage also increases, but the increase is vary small as compared with the on-voltage, such that it will be assumed that the off-voltage is fixed regardless of deterioration of the organic light emitting diode OLED).

For example, when the organic light emitting diode OLED is deteriorated, the on-voltage is set at 6V, and when it is not deteriorated, the on-voltage is set at 5V. Assume that the off-voltage of the organic light emitting diode OLED is 3V.

When the organic light emitting diode OLED is not deteriorated, the voltage of the first terminal of the compensating capacitor Cc drops from 5V to 3V, and the voltage of the first node N1 correspondingly drops. Further, when the organic light emitting diode OLED deteriorates, the voltage of the first terminal of the compensating capacitor Cc drops from 6V to 3 V, and the voltage of the first node N1 correspondingly drops. That is, the compensator 144 decreases the voltage of the first node N1 so as to compensate for the deterioration of the organic light emitting diode OLED.

Furthermore, according to an aspect of the present invention, it is possible to control the voltage of the first node regardless of the voltage drop of the second power supply ELVSS. In other words, the on-voltage and the off-voltage of the organic light emitting diode OLED are continuously supplied to the first terminal of the compensating capacitor Cc. The second power ELVSS included in the on-voltage and the second power ELVSS included in the off-voltage are offset, such that the voltage of the first node N1 is controlled regardless of the voltage drop of the second power ELVSS.

Figure 5:
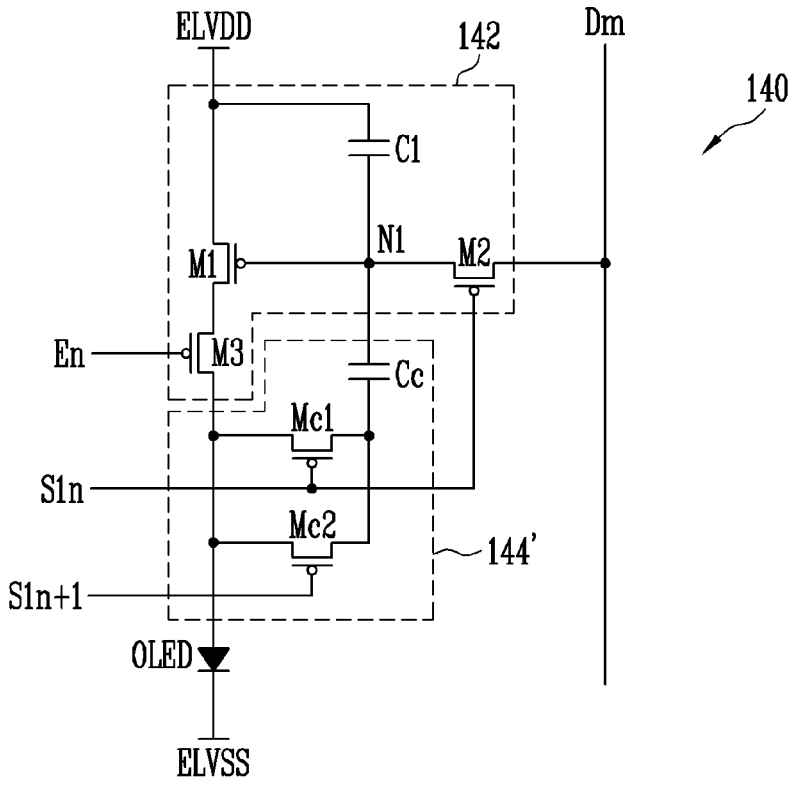
FIG. 5 is a diagram illustrating another embodiment of a pixel shown in FIG. 2.

FIG. 5 is a diagram illustrating the pixel shown in FIG. 2 according to another embodiment of the present invention. For convenience of explanation, the same components as in FIG. 3 are designated by the same reference numerals and the detailed description is not provided.

Referring to FIG. 5, a compensator 144' includes a first compensating transistor Mc1, a second compensating transistor Mc2, and a compensating capacitor Cc.

The first compensating transistor Mc1 has a first electrode connected to the anode electrode of the organic light emitting diode OLED and a second electrode connected to a first terminal of the compensating capacitor Cc. Further, a gate electrode of the first compensating transistor Mc1 is connected to the n-th first scan line S1*n*. The first compensating transistor Mc1 is turned on and electrically connects the anode electrode of the organic light emitting diode OLED with the first terminal of the compensating capacitor Cc, when a first scan signal is supplied to the n-th first scan line S1*n*.

The second compensating transistor Mc2 has a first electrode connected to the anode electrode of the organic light emitting diode OLED and a second electrode connected to a first terminal of the compensating capacitor Cc. Further, a gate electrode of the second compensating transistor Mc2 is connected to the n+1-th first scan line S1*n*+1. The second compensating transistor Mc2 is turned on and electrically connects the anode electrode of the organic light emitting diode OLED with the first terminal of the compensating capacitor Cc, when a first scan signal is supplied to the n+1-th first scan line S1*n*+1.

The first terminal of the compensating capacitor Cc is connected to the second electrodes of the first and second compensating transistor Mc1 and Mc2 and the second electrode of the compensating capacitor Cc is connected to the first node N1. The compensating capacitor Cc controls voltage of the first node N1 in accordance with voltage changes of the organic light emitting diode OLED.

In the pixel 140 described above, the on-voltage of the organic light emitting diode OLED is supplied to the compensating capacitor Cc by using the first compensating transistor Mc1 connected to the n-th first scan line S1*n*, and the off-voltage of the organic light emitting diode OLED is supplied to the compensating capacitor Cc by using the second compensating transistor Mc2 connected to the n+1-th first scan line S1*n*+1. In this case, it is possible to remove the second scan line S2*n* shown in FIG. 3.

Figure 6:
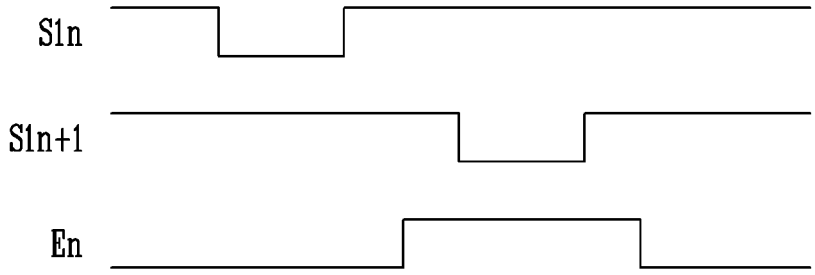
FIG. 6 is a waveform diagram illustrating a method of driving the pixel shown in FIG. 5.

FIG. 6 is a waveform diagram illustrating a method of driving the pixel shown in FIG. 5. Referring to FIG. 6, the first scan signal is first supplied to the n-th first scan line S1*n*. As the first scan signal is supplied to the n-th first scan line S1*n*, the second transistor M2 and the first compensating transistor Mc1 are turned on.

As the second transistor M2 is turned on, a data signal is supplied from the data line Dm to the first node N1, and accordingly, the first capacitor C1 is charged at a voltage corresponding to the data signal.

As the first compensating transistor Mc1 is turned on, the on-voltage of the organic light emitting diode OLED is supplied to the first terminal of the compensating capacitor Cc. That is, while the data signal is supplied to the first node N1, the first terminal of the compensating capacitor Cc is set to the on-voltage of the organic light emitting diode OLED.

Thereafter, the first scan signal is supplied to the n+1-th first scan line S1*n*+1, and the emission control signal is supplied to the emission control line En. As the emission control signal is supplied to the emission control line En, the third transistor M3 is turned off.

As the first scan signal is supplied to the n+1-th first scan line S1*n*+1, the second compensating transistor Mc2 is turned on. As the second compensating transistor Mc2 is turned on, the off-voltage of the organic light emitting diode OLED is supplied to the first terminal. The compensating capacitor Cc controls voltage of the first node N1 in accordance with voltage changes of the organic light emitting diode OLED, as expressed in Formula 1. That is, the compensating capacitor Cc controls the voltage of the first node N1 in accordance with the deterioration of the organic light emitting diode OLED, and accordingly, it is possible to compensate for the deterioration of the organic light emitting diode OLED.

Figure 7:
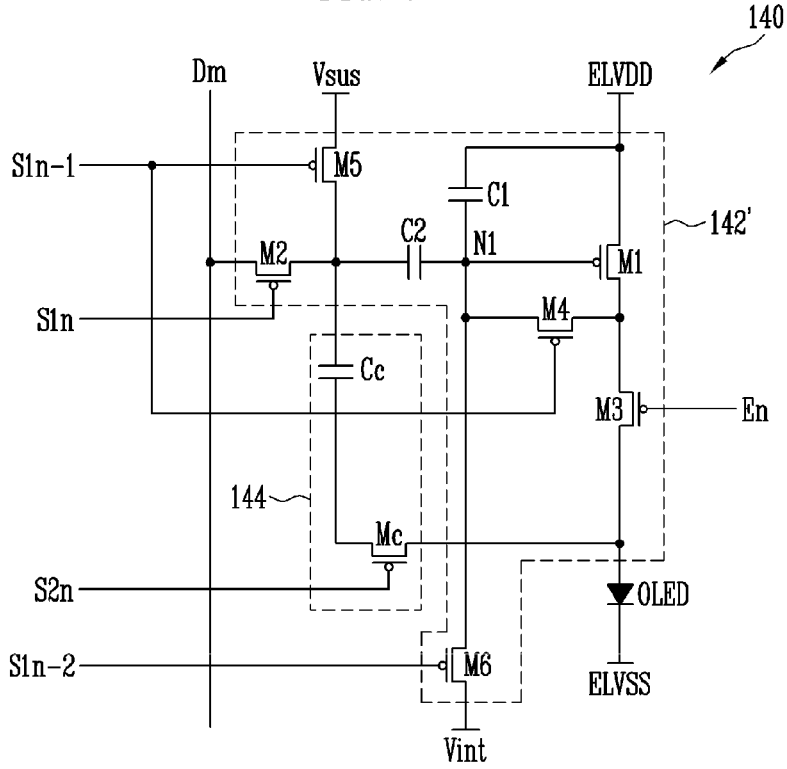
FIG. 7 is a diagram illustrating another embodiment of a pixel shown in FIG. 2.

FIG. 7 is a diagram illustrating another embodiment of the pixel shown in FIG. 2. In explaining FIG. 7, the same components as in FIG. 3 are designated by the same reference numerals and therefore a detailed description is not provided.

Referring to FIG. 7, in the pixel 140, the configuration is the same as that shown in FIG. 3, except for the pixel circuit 142'. FIG. 7 includes an embodiment modified from the pixel circuit 142', and the method of compensating for the deterioration of the organic light emitting diode OLED is the same as that illustrated in FIG. 3.

The pixel circuit 142' controls the amount of current supplied to the organic light emitting diode OLED in response to the data signal. For this operation, the pixel circuit 142' includes first to sixth transistors M1 to M6, a first capacitor C1, and a second capacitor C2.

A gate electrode of the first transistor M1 is connected to a first node N1 and a first electrode of the first transistor M1 is connected to the first power supply ELVDD. Further, a second electrode of the first transistor M1 is connected to a first electrode of the third transistor M3. The first transistor M1 supplies current corresponding to the voltage applied to the first node N1 to the organic light emitting diode OLED.

A first electrode of the second transistor M2 is connected to the data line Dm and a second electrode of the second transistor M2 is connected to the first terminal of the second capacitor C2. Further, a gate electrode of the second transistor M2 is connected to the n-th first scan line S1*n*. The second transistor M2 is turned on and electrically connects the data line Dm with the first terminal of the second capacitor C2, when a first scan signal is supplied to the n-th first scan line S1*n*.

A first electrode of the third transistor M3 is connected to a second electrode of the first transistor M1 and a second electrode of the third transistor M3 is connected to the anode of the organic light emitting diode OLED. Further, the gate electrode of the third transistor M3 is connected to the emission control line En. The third transistor having this configuration is turned off when an emission signal is supplied to the emission control line En.

A first electrode of the fourth transistor M4 is connected to a second electrode of the first transistor M1 and a first electrode of the fourth transistor M4 is connected to the first node N1. Further, a gate electrode of the fourth transistor M4 is connected to the n−1-th first scan line S1*n*−1. The fourth transistor M4 is turned on and connects the first transistor M1 in a diode type, when a first scan signal is supplied to the n−1-th scan line S1*n*−1.

A first electrode of the fifth transistor M5 is connected to a reference power supply Vsus and a second electrode of the fifth transistor M5 is connected to the first terminal of the second capacitor C2. Further, a gate electrode of the fifth transistor M5 is connected to the n−1-th first scan line S1*n*−1. The fifth transistor M5 is turned on and supplies the voltage of the reference power supply Vsus to the first terminal of the second capacitor C2, when a first scan signal is supplied to the n−1-th first scan line S1*n*−1. In this configuration, the voltage of the reference power supply Vsus is different from that of the data signal. For example, the reference power Vsus may be set at a voltage higher than the data signal.

A first electrode of the sixth transistor M6 is connected to the first node N1 and the second electrode of the sixth transistor M6 is connected to an initial power supply Vint. Further, a gate electrode of the sixth transistor m6 is connected to the n−2-th first scan line S1*n*−2. The sixth transistor M6 is turned on and supplies the voltage of the initial power supply Vint to the first node n1, when the first scan signal is supplied to the n−2-th first scan line S1*n*−2. In this configuration, the voltage of the initial power supply Vint is set lower than that of the data signals.

The first capacitor C1 is connected between the first node N1 and the first power supply ELVDD. The first capacitor C1 is charged at a voltage corresponding to a data signal and threshold voltage of the first transistor M1.

The second capacitor C2 is connected between the second electrode of the second transistor M2 and the first node N1. The second capacitor C2 is charged at a voltage corresponding to the data signal.

The compensator 144 includes a compensating transistor Mc and a compensating capacitor Cc. The compensating transistor Mc has a first electrode connected to the anode electrode of the organic light emitting diode OLED and a second electrode connected to a first electrode of the compensating capacitor Cc. Further, a gate electrode of the compensating transistor Mc is connected to the second scan line S2*n*. The compensating transistor Mc is turned on and electrically connects the anode electrode of the organic light emitting diode OLED with the first terminal of the compensating capacitor Cc, when a second scan signal is supplied to the second scan line S2*n*.

The first terminal of the compensating capacitor Cc is connected to the second electrode of the compensating transistor Mc and the second electrode of the compensating capacitor Cc is connected to the first terminal of the second capacitor C2. The compensating capacitor Cc controls voltage of the first terminal of the second capacitor C2 in accordance with voltage changes of the organic light emitting diode OLED.

Figure 8:
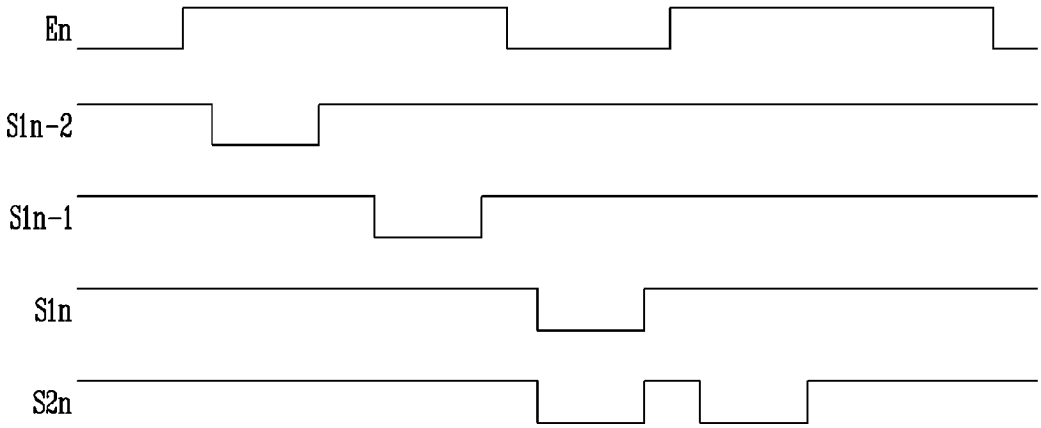
FIG. 8 is a waveform diagram illustrating a method of driving the pixel shown in FIG. 7.

FIG. 8 is a waveform diagram illustrating a method of driving the pixel shown in FIG. 7. Referring to FIG. 8, the scan driver 110 supplies an emission control signal to the emission control line Ei to overlap the first scan signal supplied to the i−1-th first scan line S1*n*−2, the i−1-th first scan line S1*n*, and the i+1-th first scan line Si+1. The emission control signal supplied to the emission control line Ei does not overlap the first scan signal supplied to the first scan line S1*n*.

Explaining the operational process in detail, first, the first scan signal is supplied to the n−2-th first scan line S1*n*−2 and the emission control signal is supplied to the emission control line En. The sixth transistor M6 is turned on and the initial power Vint is supplied to the first node N1, when the first scan signal is supplied to the n−2-th first scan line S1*n*−2. The first node N1 is initialized to the voltage of the initial power Vint.

As the emission control signal is supplied to the emission control line En, the third transistor M3 is turned off. As the third transistor M3 is turned off, the second electrode of the first transistor M1 and the organic light emitting diode OLED are electrically disconnected.

Thereafter, the first scan signal is supplied to the n−i-th first scan line S1*n*−1. Thereafter, as the first scan signal is supplied to the n−1-th first scan line Sn−1, the fourth transistor M4 and the fifth transistor M5 are turned on.

The second electrode of the first transistor M1 and the first node n1 are electrically connected, when the fourth transistor M4 is turned on. That is, the first transistor M1 is connected in a diode type. In this process, since the voltage of the first node N1 is set to the voltage of the initial power supply Vint, the first transistor M1 is turned on. As the first transistor M1 is turned on, the voltage of the first node N1 is set to the voltage obtained by subtracting the threshold voltage of the first transistor M1 from the first power supply ELVDD. The first capacitor C1 is charged to a voltage corresponding to the threshold voltage of the first transistor M1.

As the fifth transistor M5 is turned on, the voltage of the reference power supply Vsus is applied to the first terminal of the second capacitor C2. That is, the first terminal of the second capacitor C2 is set to the voltage of the reference power supply Vsus while the first capacitor C1 is charged to the voltage corresponding to the threshold voltage of the first transistor M1.

Thereafter, supply of the emission control signal to the emission control line En is stopped and the third transistor M3 is turned off. Further, the first scan signal is supplied to the n-th first scan line S1*n* and the first second scan signal is supplied to the n-th second scan line S2*n*.

As the first scan signal is supplied to the n-th first scan line S1*n*, the second transistor M2 is turned on. A data signal from the data line Dm is supplied to the first terminal of the second capacitor C2, when the second transistor M2 is turned on. In this operation, the voltage of the first terminal of the second capacitor C2 drops to the voltage of the data signal from the voltage of the reference power supply Vsus. As the voltage of the first terminal of the second capacitor C2 drops, the voltage of the first node N1 also drops in accordance with the voltage drop of the first terminal of the second capacitor C2. Since the reference power supply Vsus is set to a constant voltage, the amount of voltage drop of the first node N1 depends on the voltage of the data signal.

As the first second scan signal is supplied to the n-th second scan line S2*n*, the compensating transistor Mc is turned on. As the compensating transistor Mc is turned on, the on-voltage of the organic light emitting diode OLED is supplied to the first terminal of the compensating capacitor Cc. That is, the first terminal of the compensating capacitor Cc is set to the on-voltage of the organic light emitting diode OLED while the voltage of the data signal is supplied to the first terminal of the second capacitor C2.

Thereafter, the second second scan signal is supplied to the n-th second scan line S2*n* and the emission control signal is supplied to the emission control line En to overlap the second scan signal. As the emission control signal is supplied to the emission control line En, the third transistor M3 is turned off.

As the second second scan signal is supplied to the n-th second scan line S2*n*, the compensating transistor Mc is turned on. As the compensating transistor Mc is turned on, the off-voltage of the organic light emitting diode OLED is supplied to the first terminal of the compensating capacitor Cc. The compensating capacitor Cc controls voltage of the first terminal of the second capacitor C2, that is, the voltage of the first node, in accordance with voltage changes of the organic light emitting diode OLED. In other words, the compensating capacitor Cc controls the voltage of the first node N1 in accordance with the deterioration of the organic light emitting diode OLED, and accordingly, it is possible to compensate for the deterioration of the organic light emitting diode OLED.

Figure 9:
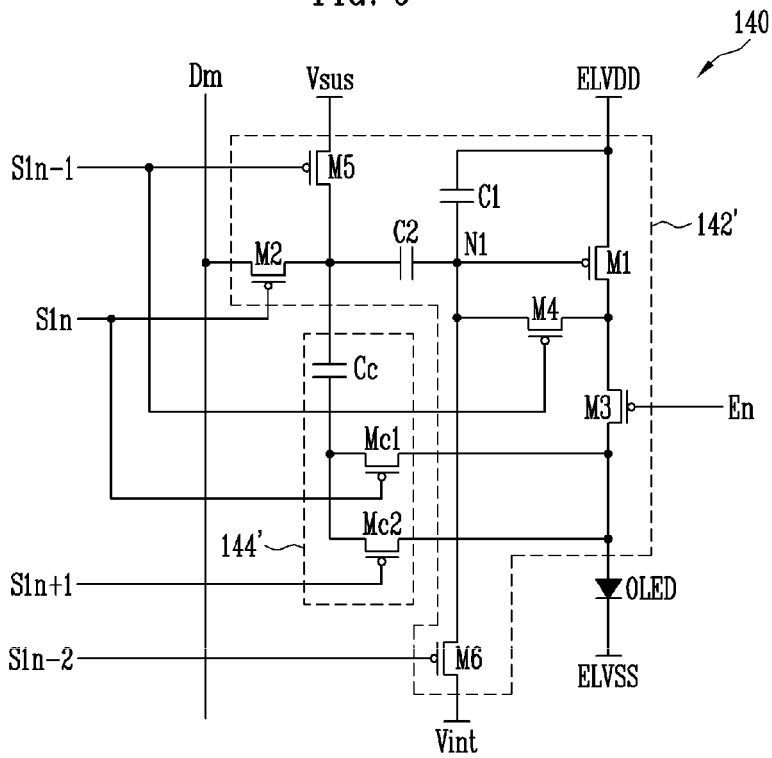
FIG. 9 is a diagram illustrating another embodiment of a pixel shown in FIG. 2.

FIG. 9 is a diagram illustrating a pixel according to another embodiment of the present invention. The pixel shown in FIG. 9 is implemented by combining configurations of the pixel circuit 142' shown in FIG. 7 and the compensator 144' shown in FIG. 5. The configurations of the pixel circuit 142' and the compensator 144' are included in the above description and their detailed description will not provided below.

Figure 10:
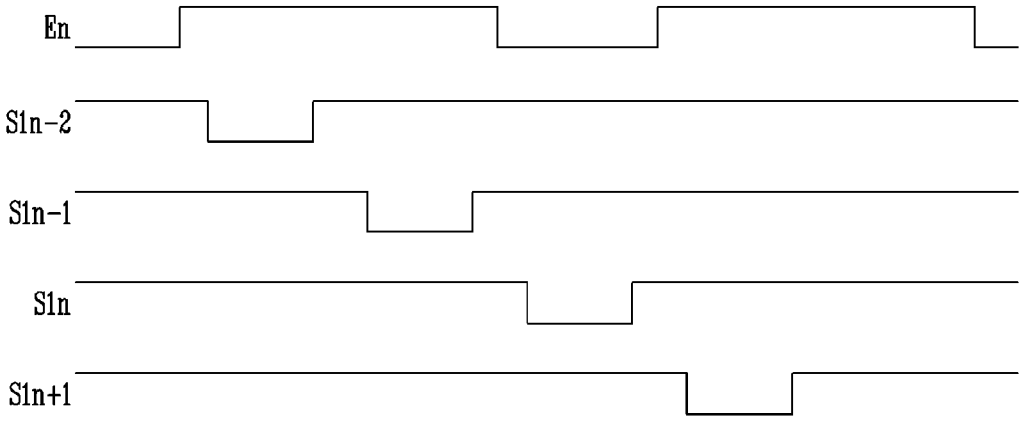
FIG. 10 is a waveform diagram illustrating a method of driving the pixel shown in FIG. 9.

FIG. 10 is a waveform diagram illustrating a method of driving the pixel shown in FIG. 9. In explaining FIG. 10, the configuration that is the same as those in the above embodiment is briefly described. Referring to FIG. 10, first, the first scan signal is supplied to the n−2-th first scan line S1*n*−2 and the emission control signal is supplied to the emission control line En. The initial power Vint is supplied to the first node N1, when the first scan signal is supplied to the n−2-th first scan line S1*n*−2. As the emission control signal is supplied to the emission control line En, the third transistor M3 is turned off.

Thereafter, as the first scan signal is supplied to the n−1-th first scan line S1*n*−1, the fourth transistor M4 and the fifth transistor M5 are turned on.

As the fourth transistor M4 is turned on, the first transistor M1 is connected in a diode type, such that the voltage of the first node N1 is set to the voltage obtained by subtracting the threshold voltage of the first transistor M1 from the first power supply ELVDD. The first capacitor C1 is charged to a voltage corresponding to the threshold voltage of the first transistor M1. As the fifth transistor M5 is turned on, the voltage of the reference power supply Vsus is applied to the first terminal of the second capacitor C2.

Thereafter, supply of emission control signal to the emission control line En is stopped and the third transistor M3 is turned off. Thereafter, the first scan signal is supplied to the n-th first scan line S1*n*.

As the first scan signal is supplied to the n-th first scan line S1*n*, the second transistor M2 and the first compensating transistor Mc1 are turned on.

A data signal from the data line Dm is supplied to the first terminal of the second capacitor C2, when the second transistor M2 is turned on. The voltage of the first terminal of the second capacitor C2 drops from the voltage of the reference power supply Vsus to the voltage of the data signal and the voltage of the first node N1 also drops in accordance with the voltage drop of the first terminal of the second capacitor C2. As the first compensating transistor Mc1 is turned on, the on-voltage of the organic light emitting diode OLED is supplied to the first terminal of the compensating capacitor Cc.

Thereafter, the first scan signal is supplied to the n+1-th first scan line S1*n*+1, such that the second compensating transistor Mc2 is turned on and the emission control signal is supplied to the emission control line En. As the emission control signal is supplied to the emission control line En, the third transistor M3 is turned off.

As the second compensating transistor Mc2 is turned on, the off-voltage of the organic light emitting diode OLED is supplied to the first terminal of the compensating capacitor Cc. The compensating capacitor Cc controls voltage of the first terminal of the second capacitor C2, that is, the voltage of the first node, in accordance with voltage changes of the organic light emitting diode OLED. In other words, the compensating capacitor Cc controls the voltage of the first node N1 in accordance with the deterioration of the organic light emitting diode OLED, and accordingly, it is possible to compensate for the deterioration of the organic light emitting diode OLED.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A pixel comprising:

an organic light emitting diode;

a pixel circuit including a driving transistor controlling an amount of current supplied to the organic light emitting diode; and a compensator compensating for the deterioration of the organic light emitting diode by using on-voltage applied when current flows in the organic light emitting diode and off-voltage applied when current does not flow in the organic light emitting diode;

wherein the compensator includes:

a compensating capacitor having a second terminal connected to a gate electrode of the driving transistor; and a first compensating transistor connected between a first terminal of the compensating capacitor and an anode electrode of the organic light emitting diode, wherein the on-voltage is supplied to the first terminal of the compensating capacitor while the first compensating transistor is turned on.

2. The pixel as claimed in claim 1, wherein the driving transistor controls the current flowing to the organic light emitting diode in response to a data signal transmitted when a first scan signal is supplied to an i-th (i is a natural number) first scan line.

3. The pixel as claimed in claim 2, wherein the first compensating transistor is turned on for a first period and a second period after the first period of one frame period, in response to a second scan signal supplied to an i-th second scan line.

4. The pixel as claimed in claim 3, wherein the first period is a period when the first scan signal is supplied to the i-th first scan signal and the second period is a period when the first scan signal is supplied to an i+1-th first scan line.

5. The pixel as claimed in claim 3, wherein the on-voltage is supplied to the first terminal of the compensating capacitor for the first period and the off-voltage is supplied to the first terminal of the compensating capacitor for the second period.

6. The pixel as claimed in claim 2, wherein the compensator further includes a second compensating transistor that is connected between the first terminal of the compensating capacitor and the anode electrode of the organic light emitting diode and is turned on at a different time from the first compensating transistor.

7. The pixel as claimed in claim 6, wherein the first compensating transistor is turned on when the first scan signal is supplied to the 1-th first scan line and the second compensating transistor is turned on when the first scan signal is supplied to the i+1-th first scan line.

8. The pixel as claimed in claim 7, wherein the off voltage is supplied to the first terminal of the compensating capacitor when the second compensating transistor is turned on.

9. The pixel as claimed in claim 2, wherein the pixel circuit includes:

a first capacitor connected between a gate electrode of the driving transistor and a first power supply;

a second transistor connected between the gate electrode of the driving transistor and a data line and turned on when the first scan signal is supplied to the i-th first scan line; and a third transistor connected between a second electrode of the driving transistor and the organic light emitting diode and turned off when an emission control signal is supplied to an i-th emission control line.

10. The pixel as claimed in claim 9, wherein the emission control signal supplied to the i-th emission control line overlaps the first scan signal supplied to an i+1-th first scan line.

11. The pixel as claimed in claim 9, wherein the pixel circuit further includes:

a fourth transistor connected between the gate electrode and the second electrode of the driving transistor and turned on when the first scan signal is supplied to the i-1-th scan line;

a fifth transistor connected between the second electrode of the second transistor and a reference power supply and turned on when the first scan signal is supplied to the i-1-th first scan line; and a sixth transistor connected between the gate electrode of the driving transistor and an initial power supply and turned on when the first scan signal is supplied to the i-2-th first scan line.

12. The pixel as claimed in claim 11, wherein the reference power supply is set to a voltage higher than the data signal.

13. The pixel as claimed in claim 11, wherein the initial power supply is set to a voltage lower than the data signal.

14. The pixel as claimed in claim 11, wherein the emission control signal supplied to the i-th emission control line overlaps the first scan signal supplied to an i-2-th first scan line, an i−1-th first scan line, and an i+1-th first scan line, except for the first scan line supplied to the i-th first scan line.

15. The pixel as claimed in claim 11, wherein the second terminal of the compensating capacitor is connected to the second electrode of the second transistor.

16. The pixel as claimed in claim 1, wherein as the on-voltage of the organic light emitting diode increases due to deterioration of the organic light emitting diode, a ratio of the on-voltage to the off-voltage also increases.

17. An organic light emitting display device, comprising:

a scan driver sequentially supplying first scan signals to first scan lines;

a data driver supplying data signals to data lines to be synchronized with the first scan signals; and pixels positioned at intersections of the first scan lines and the data lines, wherein the pixels positioned in an i-th (i is a natural number) horizontal line each include:

a pixel circuit including a driving transistor controlling an amount of current supplied to the organic light emitting diode; and a compensator compensating deterioration of the Organic light emitting diode by using on-voltage applied when current flows in the organic light emitting diode and off-voltage applied when current does not flow in the organic light emitting diode, and the compensator includes:

a compensating capacitor having a second terminal connected to a gate electrode of the driving transistor; and a first compensating transistor connected between a first terminal of the compensating capacitor and an anode electrode of the organic light emitting diode, wherein the on-voltage is supplied to the first terminal of the compensating capacitor while the first compensating transistor is turned on.

18. The organic light emitting display device as claimed in claim 17, wherein second scan lines are formed in parallel with the first scan lines, and the first compensating transistor is turned on when a second scan signal is supplied to an i-th second scan line.

19. The organic light emitting display device as claimed in claim 18, wherein the scan driver supplies a first second scan signal to the i-th second scan line to overlap with the first scan signal supplied to an i-th first scan line, and supplies a second second scan signal to the i-th second scan line to overlap the second scan signal supplied to an i+1-th scan line.

20. The organic light emitting display device as claimed in claim 17, wherein the compensator further includes a second compensating transistor that is connected between the first terminal of the compensating capacitor and the anode electrode of the organic light emitting diode and is turned on at a different time from the first compensating transistor.

21. The organic light emitting display device as claimed in claim 17, wherein the first compensating transistor is turned on when the first scan signal is supplied to the 1-th first scan line and the second compensating transistor is turned on when the first scan signal is supplied to the i+1-th first scan line.

22. The organic light emitting display device as claimed in claim 17, wherein the pixel circuit includes:

a first capacitor connected between a gate electrode of the driving transistor and a first power supply;

a second transistor connected between the gate electrode of the driving transistor and a data line and turned on when the first scan signal is supplied to the i-th first scan line; and a third transistor connected between a second electrode of the driving transistor and the organic light emitting diode and turned off when an emission control signal is supplied to an i-th emission control line.

23. The organic light emitting display device as claimed in claim 22, wherein the scan driver supplies the emission control signal to the i-th emission control line to overlap the first scan signal supplied to the i+1-th first scan line.

24. The organic light emitting display device as claimed in claim 22, wherein the pixel circuit further includes:

a fourth transistor connected between the gate electrode and the second electrode of the driving transistor and turned on when the first scan signal is supplied to the i−1-th scan line;

a fifth transistor connected between the second electrode of the second transistor and a reference power supply and turned on when the first scan signal is supplied to the i−1-th first scan line; and a sixth transistor connected between the gate electrode of the driving transistor and an initial power supply and turned on when the first scan signal is supplied to the i−2-th first scan line.

25. The organic light emitting display device as claimed in claim 24, wherein the scan driver supplies an emission control signal to the i-th emission control line to overlap the first scan signals supplied to the i−2-th first scan line, the i−1-th scan line, and the i+1-th first scan line.

26. The organic light emitting display device as claimed in claim 25, wherein the scan driver supplies the emission control signal to the i-th emission control line not to overlap the first scan signal supplied to the i-th first scan line.

27. The organic light emitting display device as claimed in claim 17, wherein as the on-voltage of the organic light emitting diode increases due to a deterioration of the organic light emitting diode, a ratio of the on-voltage to the off-voltage also increases.

* * * * *